US008029232B2

(12) United States Patent
Wyatt

(10) Patent No.: US 8,029,232 B2
(45) Date of Patent: Oct. 4, 2011

(54) SANITARY AIR JET DEVICE

(76) Inventor: Dwight Wyatt, Williamsport, PA (US)

( * ) Notice: Subject to any disclaimer, the term of this patent is extended or adjusted under 35 U.S.C. 154(b) by 630 days.

(21) Appl. No.: 12/200,913

(22) Filed: Aug. 28, 2008

(65) Prior Publication Data

US 2009/0060705 A1 Mar. 5, 2009

Related U.S. Application Data

(60) Provisional application No. 60/967,172, filed on Aug. 31, 2007.

(51) Int. Cl.
*F01D 25/26* (2006.01)

(52) U.S. Cl. ..... 415/116; 415/144; 415/198.1

(58) Field of Classification Search ..... 415/116, 415/144, 198.1
See application file for complete search history.

(56) References Cited

U.S. PATENT DOCUMENTS

2008/0213083 A1* 9/2008 Unno ..... 415/4.2
2009/0060705 A1* 3/2009 Wyatt ..... 415/1

* cited by examiner

*Primary Examiner* — George Fourson, III

(57) ABSTRACT

A sanitary air jet device [1000] is operated by a user blowing air into its first stage inlet [1111] of a mouthpiece [1110]. The air stream causes a first stage turbine [1130] to rotate and spin a shaft [1205]. The shaft passes through a separator wall [1140]. A second stage turbine [1230] is connected to the shaft [1205] on the other side of the separator wall [1140] in a second stage chamber [1201]. The shaft [1205] causes second stage turbine [1230] to spin and draw air in through a number of second stage inlets [1211] in the second stage chamber [1201]. The second stage turbine [1230] blows the clean air out of a second stage exhaust [1221]. The second stage chamber [1201] is separated from the first stage chamber [1101] such that it does not receive the air blown in by the user. Therefore, one may blow out candles on a cake with clean air and no longer spray saliva droplets and microbes on the cake.

19 Claims, 5 Drawing Sheets

SANITARY AIR JET DEVICE

CROSS REFERENCE TO RELATED APPLICATIONS

This patent application claims priority from U.S. Provisional patent application Ser. No. 60/967,172 "Sanitary Air Jet Device" filed Aug. 31, 2007 by the same inventor as the present application, Dwight Wyatt. This application therefore claims the priority date of Aug. 31, 2007.

FEDERAL SPONSORED RESEARCH

Not Applicable

SEQUENCE LISTING OR PROGRAM

Not Applicable

BACKGROUND OF THE INVENTION

1. Field of the Invention

The present invention relates to a device which allows a user to blow a sanitary stream of air.

2. Discussion of Related Art

It is a common custom to have a cake with candles to celebrate a holiday, birthday or other occasion. As part of this celebration, one or more people blow out the candles on the cake.

This custom is widespread throughout the US and many other countries.

Typically the people blowing out the candles do not use any alternative devices. By blowing without any additional aids, it is common that small droplets of bodily fluids, such as saliva and mucus, are sprayed onto the cake at a close distance. These may be so small that they are invisible to the unaided eye; however, rapid photography has shown the existence of a good deal of airborne droplets.

Many pathogenic diseases are transported from host to host in bodily fluids. These droplets may be airborne and breathed into the lungs as is the case with a respiratory virus, or may land on a surface, be touched by the hand of a host and eventually make their way into the host's mouth, eyes or nose, causing the infection.

In the present case, the droplets are blown directly onto the cake which the participants at the celebration eat, causing potential infections.

The droplets are also airborne which are breathed in by the participants. They also settle onto surfaces, are touched by the participants, then make their way into the participant's mouth, nose or eyes when they are wiped.

Children also use toys which they blow into which make sounds and cause objects to move and spin. These all have the same problem of spewing bodily fluids into the air, on other children and surfaces in which diseases may spread.

Currently, there is a need for a more sanitary method of celebrating occasions, and using mouth-operated toys which limit the spread of disease.

SUMMARY OF THE INVENTION

One embodiment of the present invention is a sanitary air jet device [1000] operated by a user comprising:

a) A mouthpiece [1110] for receiving a stream of air from said user;

b) a first stage turbine [1130] adjacent the mouthpiece [1110], whereby the first stage turbine [1130] rotates when air passes through the mouthpiece [1110] and passes through the first stage turbine [1130];

c) a separator wall [1140] functioning to divert air flowing through the first stage turbine [1130] to another direction;

d) a second stage chamber [1201] being separated from the first stage turbine [1130] such that it does not receive the air flowing through first stage turbine [1130];

e) at least one second stage inlet [1211] allowing air to flow into the second stage chamber [1201];

f) at least one second stage exhaust [1221] allowing air to flow out of the second stage chamber [1201];

g) a second stage turbine [1230] in the second stage chamber [1201] whereby the second stage turbine [1230] collects air from the second stage inlets [1211] and blows air out of the second stage exhaust [1221] when rotated;

h) a shaft [1205] connecting the first stage turbine [1130] to the second stage turbine [1230] causing the second stage turbine [1230] to spin when the first stage turbine [1130] spins causing the second stage turbine [1230] to collect air from the second stage inlets [1211] and the second stage turbine [1230] blowing the collected clean air out of the second stage exhaust [1221].

The first stage turbine [1130] has a plurality of angled fins [1131] which cause it to rotate when air is blown through them. Similarly, second stage turbine [1230] also has a plurality of angled fins [1231] causing second stage turbine [1230] to rotate when air is passed through it.

The present invention may also be embodied as a sanitary air jet [1000] for creating a stream of clean air to blow onto an object from a stream of air blown by the mouth of a user comprising:

a) a first stage turbine [1130] having angled fins [1131] designed to rotate when it receives a stream of air passing through it;

b) a first stage inlet [1111] for receiving a stream of air from said user and directing it through the first stage turbine [1130];

c) a separator wall [1140] functioning to divert the stream of air flowing through the first stage turbine [1130] to another direction;

d) a second stage chamber [1201] being separated from the first stage turbine [1130] such that it does not receive the air flowing through first stage turbine [1130];

e) at least one second stage inlet [1211] allowing air to flow into the second stage chamber [1201];

f) at least one second stage exhaust [1221] allowing air to flow out of the second stage chamber [1201];

g) a second stage turbine [1230] in the second stage chamber [1201] coupled to, and driven by the first stage turbine [1130] whereby the first stage turbine [1130] rotates the second stage turbine [1230] causing it to draw in clean air through the second stage inlets [1211] and blow the clean air out of the second stage exhaust [1221] as a clean stream of air when rotated.

The present invention may also be embodied as a method of converting an air stream blown by the mouth of a user into a stream of clean air to blow onto an object comprising the steps of:

a) receiving said user's air stream through a first stage inlet [1111];

b) passing the user's air stream through a first stage turbine [1130] causing first stage turbine [1130] to rotate;

c) exhausting the user's air stream out of a first stage exhaust [1120];

d) rotating a second stage turbine [1230] with the first stage turbine [1130] causing the second stage turbine [1230] to draw in clean air and blow it out of a second stage exhaust [1221] as a stream of clean air.

OBJECTS OF THE INVENTION

It is an object of the present invention to provide a mouth-operated device for blowing sanitary air.

It is another object of the present invention to provide a mouth-operated device which collects clean air and forces it out its outlet.

It is another object of the present invention to provide a mouth-operated device which minimizes the spray of bodily fluids.

It is another object of the present invention to provide a mouth-operated device to provide a sanitary children's toy.

BRIEF DESCRIPTION OF THE DRAWINGS

The advantages of this disclosure will become more apparent when read with the specification and the drawings, wherein.

DETAILED DESCRIPTION OF THE INVENTION

Figure 1:
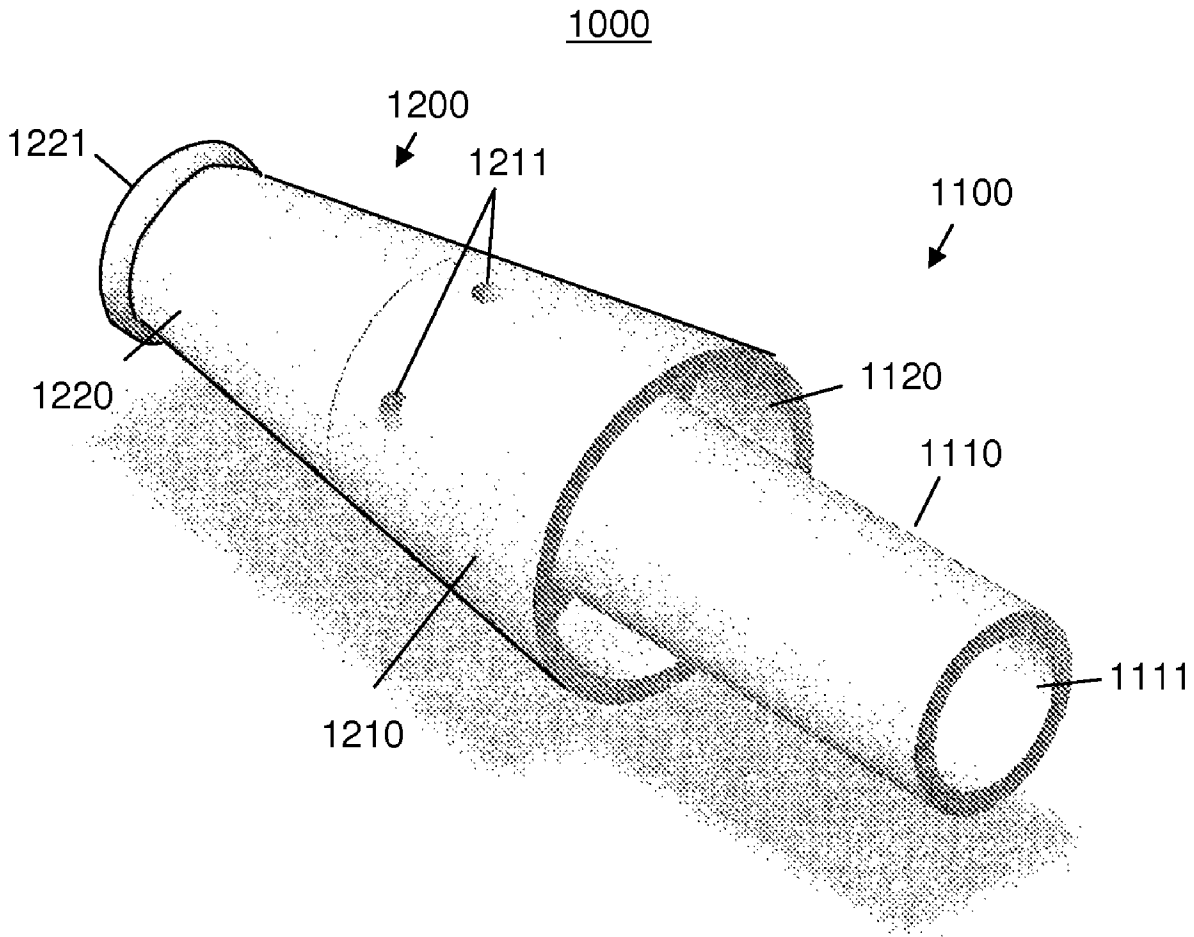
FIG. 1 shows a perspective view of a sanitary air jet device 1000 according to one embodiment of the present invention.
Figure 2:
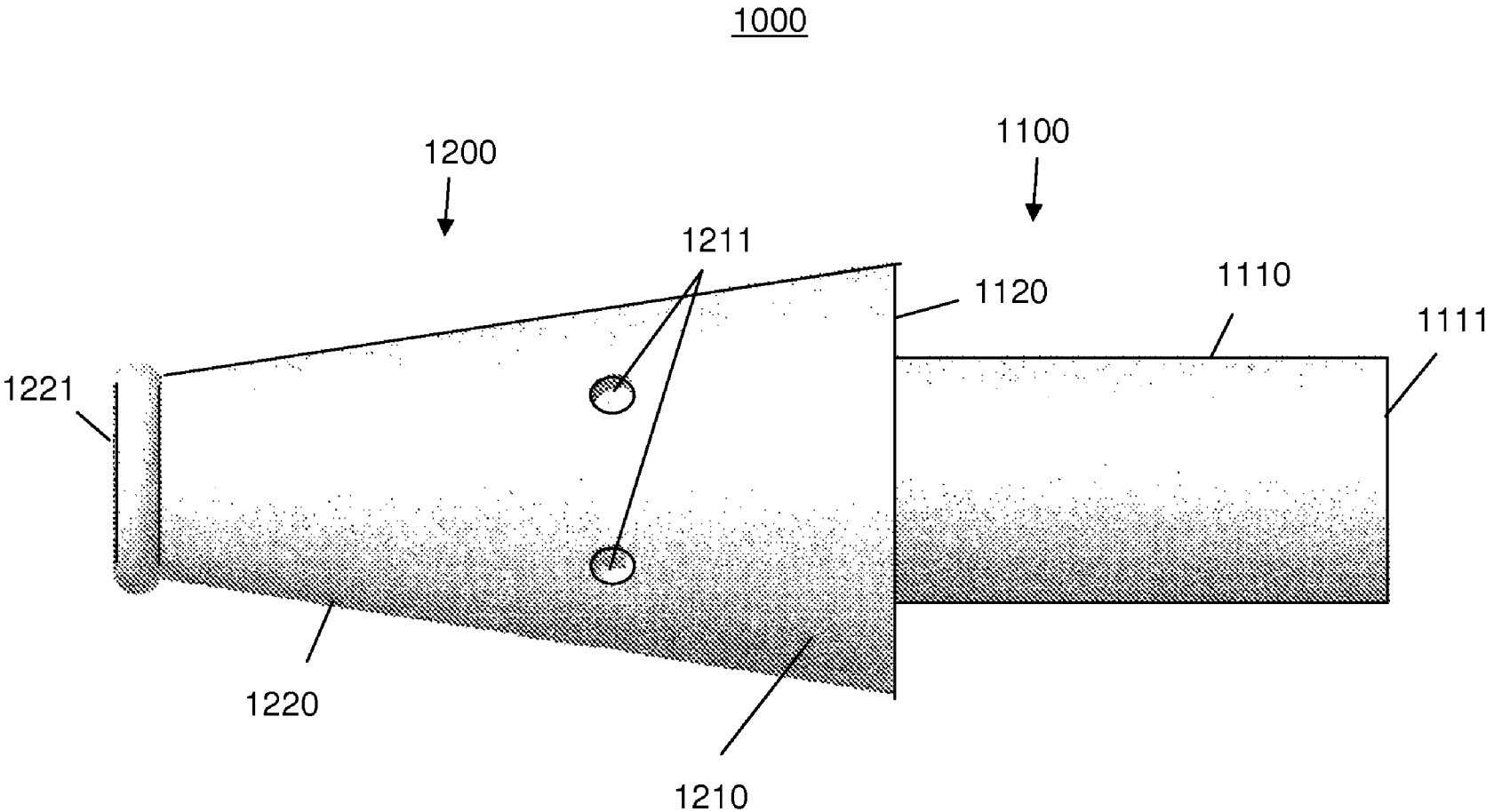
FIG. 2 shows a side view of the sanitary air jet device 1000 of the embodiment of the present invention shown in FIG. 1.

FIG. 1 shows a perspective view of a sanitary air jet device 1000 according to one embodiment of the present invention. FIG. 2 is a side view of the embodiment of FIG. 1.

With regard to FIGS. 1 and 2, the sanitary air jet device 1000 is designed to provide an air jet and prevent or limit the spread of airborne microbes.

It functions employing two stages, a first stage 1100 and a second stage 1200. The first stage 1100 is operated by a user blowing air into a first stage inlet 1111 of mouthpiece 1110.

The air blown by the user into the first stage inlet 1111 of mouthpiece 1110 exits out of a first stage exhaust 1120 which is a gap between the cowling 1210 and the mouthpiece 1110. Due to the geometry of this opening, the air is directed back toward the user.

The sanitary air jet device 1000 employs the energy from air being blown into the mouthpiece 1110 into the first stage 1100 to power the second stage 1200.

In the second stage 1200, clean air is drawn in through a plurality of second stage inlets 1211. It then forces the clean air out of a second stage exhaust 1221 of a nozzle 1220.

Nozzle 1220 directs and increases the velocity of the clean air exiting second stage exhaust 1221.

Figure 3:
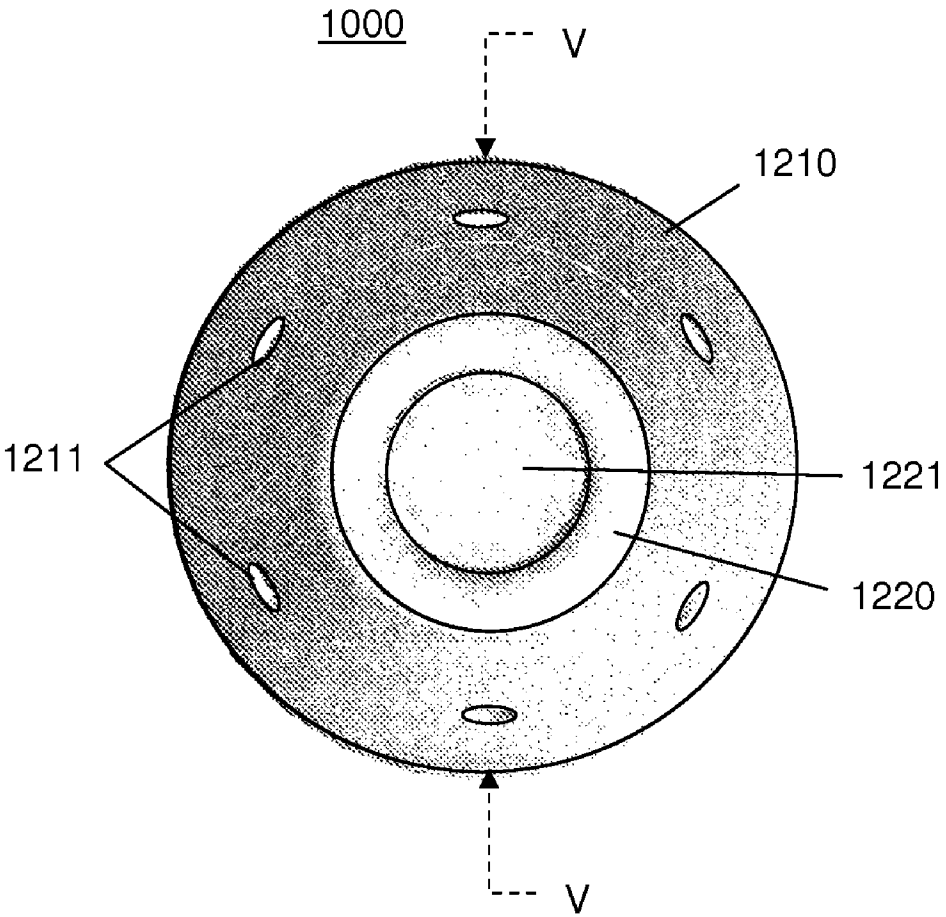
FIG. 3 is an end-on view of the embodiment of the present invention of FIGS. 1 and 2.

FIG. 3 is an end-on view of the sanitary air jet device 1000 as viewed from the second stage exhaust 1221 shown in FIGS. 1 and 2. Here the second stage exhaust 1221 of nozzle 1220 is visible. Second stage inlets 1211 of the second stage 1200 are also visible. Cowling 1210 extends to a large outer diameter as shown in this figure.

Figure 4:
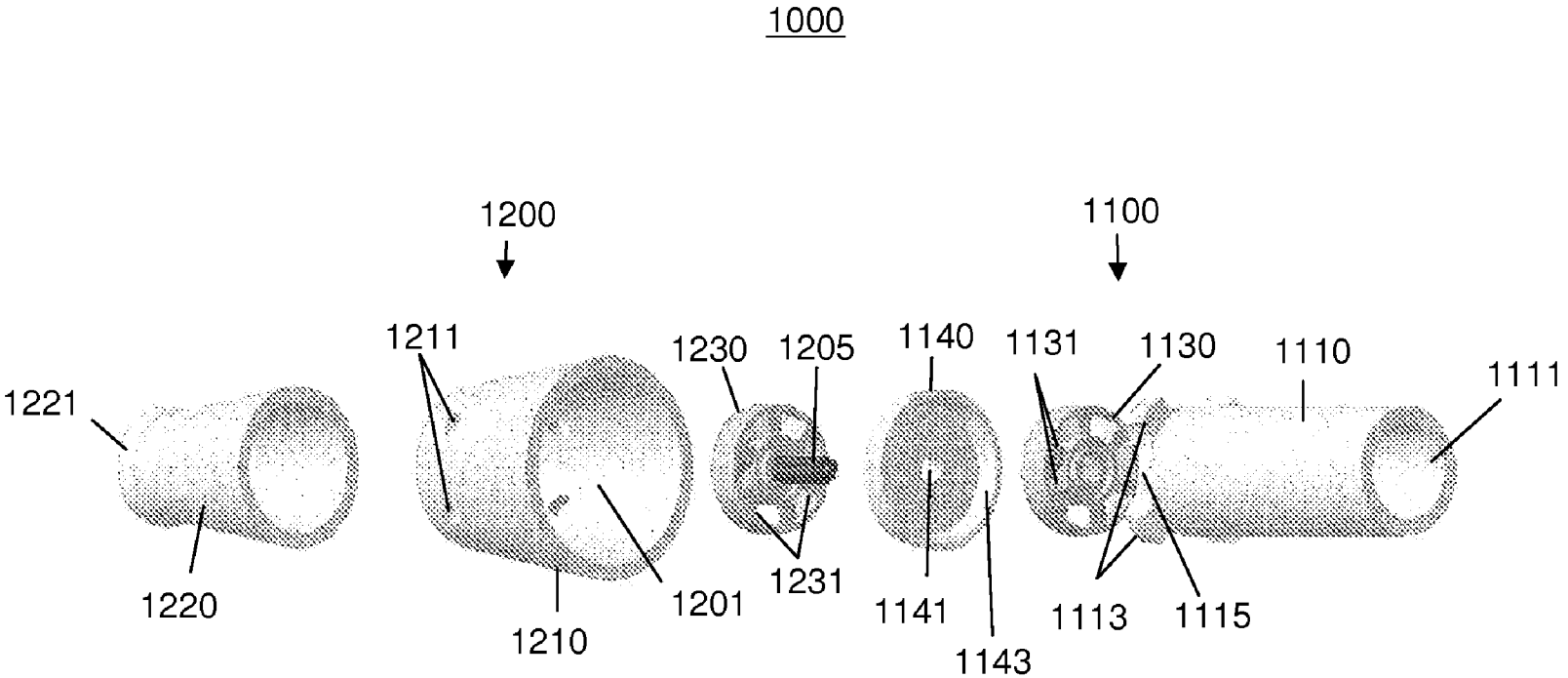
FIG. 4 is an exploded perspective diagram of the embodiment of the present invention shown in FIGS. 1, 2 and 3 showing the internal parts of the device.

FIG. 4 is an exploded perspective diagram of the embodiment of the present invention shown in FIGS. 1-3, showing the internal parts of the device 1000.

Mouthpiece 1110 employs at least two side supports 1113 which fit against the inside of cowling 1210 supporting mouthpiece 1110.

A first stage turbine 1130 fits on a shaft 1205 which passes through a separator wall hole 1141. The first stage turbine 1130 has angled fins 1131 which cause rotary motion of the first stage turbine 1130 as a stream of air passes through it. The number and degree of angle of the blades affect the speed of rotation of first stage turbine 1130 as known in the art of aerodynamics.

Shaft 1205 attaches to another turbine, named the second stage turbine 1230. These are fixed to each other and designed to rotate together.

Separator wall 1140 is designed to fit flush against the inside of cowling 1210 substantially parallel to the turbines 1130, 1230. The separator wall 1140 separates the first stage 1100 from the second stage 1200 creating a second stage chamber 1201 around second stage turbine 1230.

Separator wall 1140 also should be substantially airtight stopping or limiting the flow of air blown into the first stage 1100 from the user into the second stage chamber 1201.

The air is blown into the first stage 1100 through first stage turbine 1130 causing it to rotate. Since it is attached to shaft 1205, it turns shaft 1205.

Separator wall hole 1141 is sized to allow shaft 1205 to rotate, however, small enough to not leave extra room for a large amount of air to pass through it to the second stage 1200.

The air blown into the first stage 1100 past the first stage turbine 1130 then impinges upon the separator wall hole 1141. As it hits, it splatters along the wall and radially outward. The outer perimeter of separator wall hole 1141 is an separator wall lip 1143 which directs the blown air radially outward and back toward cowling 1210, out first stage exhaust (1120 of FIG. 1) and toward the user.

Since separator wall 1140 fits against the inner surface of cowling 1210, it creates a chamber in the second stage 1200. Second stage turbine 1230 is inside of this second stage chamber 1201. Since second stage turbine 1230 is connected to first stage turbine 1130 by shaft 1205, second stage turbine spins. Its angled fins 1231 are shaped to take air into the second stage chamber 1201 on the other side of separator wall 1140 and blow it towards the nozzle 1220. Since separator wall 1140 fits tightly against the inside of cowling 1210, little or no air from the first stage 1100 can pass into the second stage 1200.

Therefore, a partial vacuum is created between second stage turbine 1230 and separator wall 1140 inside of the second stage chamber 1201. Since there are second stage inlets 1211 in cowling 1210, outside air is taken in through these holes, then blown by spinning second stage turbine 1230 out of nozzle 1220.

Any bodily fluids which are inadvertently blown into the mouthpiece 1110 of the first stage 1100 pass through first stage turbine 1130.

They then impinge upon separator wall 1140. Since shaft 1205 is sized to closely fit separator wall hole 1141, there is little chance that the fluids pass separator wall 1140.

The fluids then flow radially outward and are forced backward toward the user. The fluids may pass through the support gaps 1115 between side supports 1113 of mouthpiece 1110, and collect in cowling 1210.

The device may be adapted to have a small reservoir on cowling 1210 to hold any fluids temporarily.

The air blown out of nozzle 1220 and toward any cakes or celebration participants is clean air, devoid of any bodily fluids.

Figure 5:
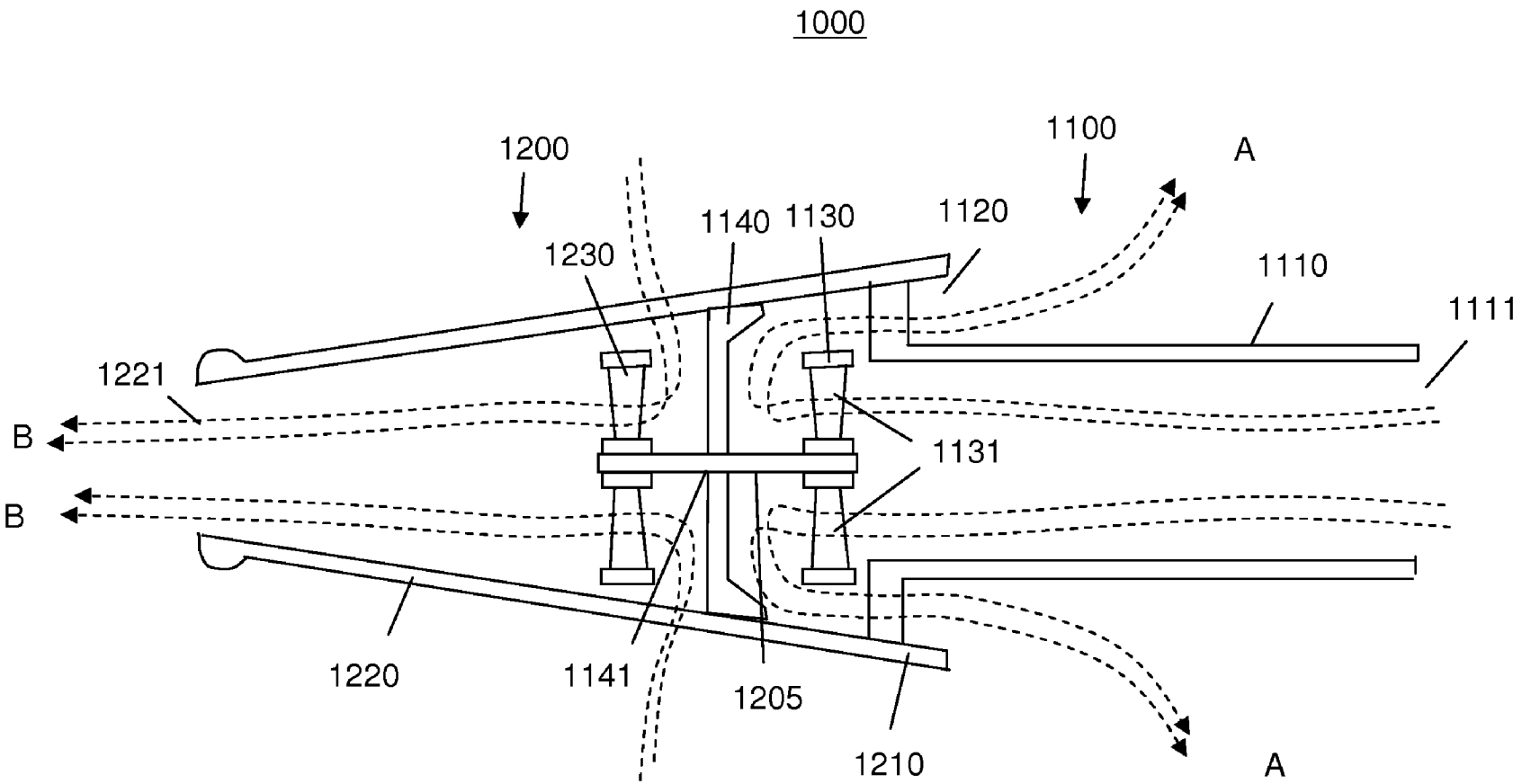
FIG. 5 shows a sectional side view along lines V-V of FIG. 3 of the sanitary air jet device 1000 of the embodiment of the present invention shown in FIG. 1.

FIG. 5 shows a sectional side view along lines V-V of FIG. 3 of the sanitary air jet device 1000 of the embodiment of the present invention shown in FIG. 1.

The first stage 1100 and a second stage 1200 are shown here. The first stage 1100 is operated by a user blowing air by mouth into a first stage inlet 1111 of mouthpiece 1110.

The air blown by the user into the first stage inlet 1111 of mouthpiece 1110 passes through the angled fins 1131 of the first stage turbine 1130. This causes first stage turbine 1130 to rotate.

The air stream from the user then impinges upon separator wall 1140 and is directed outwardly and backward to exit out of a gap between the cowling 1210 and the mouthpiece 1110 being the first stage exhaust 1120. Due to the geometry of this opening, the air is directed back toward the user. Therefore, any airborne saliva and microbes are directed back to the user and away from any target objects, such as a birthday cake.

The device 1000 employs the energy from air being blown into the mouthpiece 1110 in the first stage 1100 to power the second stage 1200.

The shaft 1205 is connected to first stage turbine 1130 and passed through separator wall 1140 and is connected to second stage turbine 1230. Therefore, first stage turbine 1130 powers second stage turbine 1230 causing it to rotate.

Since separator wall 1140 fits tightly against cowling 1210, there is no leakage of the airstream blown by the user into the second stage 1200. Also, separator wall hole 1141 is designed to fit closely around shaft 1205 and is sized to provide little or no air leakage, while still allowing shaft 1205 to freely rotate.

In the second stage 1200, as second stage turbine 1230 rotates, it draws clean air in through the plurality of second stage inlets 1211. These inlets are located in positions which are designed to draw in clean air without drawing in any of the air blown in by the user into the first stage 1100.

Second stage turbine 1230 then forces the clean air out of the second stage exhaust 1221 of nozzle 1220.

This results in a device which allows a user to blow into the device and cause it to blow a clean and sanitary stream of air toward an object, such as a lit candle on a birthday cake.

The same type of problem arises with other blow toys. Party favors, sirens and whistles are usually aimed at another person when blown. Inadvertently, they spray bodily fluids and microbes. The present invention may be used in place of these with some modification.

Also, structures such as protrusions and holes may be added to one or more of the turbines 1130, 1230 to create a whistle, siren, buzzing or whining sound. This may create an aesthetic appeal to the device and allow it to be used also as a toy.

Either the first stage turbine or second stage turbine can be modified to make a siren noise when they rotate.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A sanitary air jet [1000] for creating a stream of clean air to blow onto an object from a stream of air blown by the mouth of a user comprising:

a) a first stage turbine [1130] having angled fins [1131] designed to rotate when it receives a stream of air passing through it;

b) a first stage inlet [1111] for receiving a stream of air from said user and directing it through the first stage turbine [1130];

c) a first stage exhaust [1120] for exhausting the user's air stream;

d) at least one second stage inlet [1211] for drawing clean air into the sanitary air jet [1000];

e) a second stage exhaust [1221] allowing a stream of clean air to flow out of the sanitary air jet [1000];

f) a second stage turbine [1230] coupled to, and driven by the first stage turbine [1130] causing the second stage turbine [1230] to draw in clean air through the second stage inlets [1211] and blow the clean air out of the second stage exhaust [1221] as a clean air stream when rotated.

2. The sanitary air jet [1000] of claim 1 further comprising:

a separator wall [1140] functioning to keep the user's air stream separate from the clean air stream and create a first stage chamber [1101] enclosing the first stage turbine [1130] and a second stage chamber [1201] enclosing the second stage turbine [1230].

3. The sanitary air jet [1000] of claim 1, further comprising:

a shaft [1205] coupling the first stage turbine [1130] to the second stage turbine [1230] causing the first stage turbine [1130] to drive the second stage turbine [1230].

4. The sanitary air jet [1000] of claim 1 wherein the first stage turbine [1130] has a plurality of angled fins [1131] which cause it to rotate when a stream of air passes through the first stage turbine [1130].

5. The sanitary air jet [1000] of claim 1 wherein the second stage turbine [1230] has a plurality of angled fins [1231] causing second stage turbine [1230] to rotate when air is passed through it.

6. The sanitary air jet [1000] of claim 1 further comprising:

a structure of at least one of the turbines [1130, 1230] which produces a siren sound.

7. The sanitary air jet [1000] of claim 1 further comprising:

a structure of at least one of the turbines [1130, 1230] which produces a whistle sound.

8. A sanitary air jet [1000] for creating a stream of clean air to blow onto an object from a stream of air blown by the mouth of a user comprising:

a) a first stage turbine [1130] having angled fins [1131] designed to rotate when it receives a stream of air passing through it;

b) a first stage inlet [1111] for receiving a stream of air from said user and directing it through the first stage turbine [1130];

c) a separator wall [1140] functioning to divert the stream of air flowing through the first stage turbine [1130] to another direction;

d) a second stage chamber [1201] being separated from the first stage turbine [1130] such that it does not receive the air flowing through first stage turbine [1130];

e) at least one second stage inlet [1211] allowing air to flow into the second stage chamber [1201];

f) at least one second stage exhaust [1221] allowing air to flow out of the second stage chamber [1201];

g) a second stage turbine [1230] in the second stage chamber [1201] coupled to, and driven by the first stage turbine [1130] whereby the first stage turbine [1130] rotates the second stage turbine [1230] causing it to draw in clean air through the second stage inlets [1211] and blow the clean air out of the second stage exhaust [1221] as a clean stream of air when rotated.

9. The sanitary air jet [1000] of claim 8, further comprising:

a shaft [1205] coupling the first stage turbine [1130] to the second stage turbine [1230] causing the first stage turbine [1130] to drive the second stage turbine [1230].

10. The sanitary air jet [1000] of claim 8 wherein the first stage turbine [1130] has a plurality of angled fins [1131] which cause it to rotate when a stream of air passes through the first stage turbine [1130].

11. The sanitary air jet [1000] of claim 8 wherein the second stage turbine [1230] has a plurality of angled fins [1231] causing second stage turbine [1230] to rotate when air is passed through it.

12. The sanitary air jet [1000] of claim 8 further comprising:

a structure of at least one of the turbines [1130, 1230] which produces a siren sound.

13. The sanitary air jet [1000] of claim 8 further comprising:

a structure of at least one of the turbines [1130, 1230] which produces a whistle sound.

14. A method of converting an air stream blown by the mouth of a user into a stream of clean air to blow onto an object comprising the steps of:

a) receiving said user's air stream through a first stage inlet [1111];

b) passing the user's air stream through a first stage turbine [1130] causing first stage turbine [1130] to rotate;

c) exhausting the user's air stream out of a first stage exhaust [1120];

d) rotating a second stage turbine [1230] with the first stage turbine [1130] causing the second stage turbine [1230] to draw in clean air and blow it out of a second stage exhaust [1221] as a stream of clean air.

15. The method of claim 14 further comprising the step of:

directing the stream of clean air to impinge upon said object.

16. The method of claim 15 wherein said object is at least one lit candle.

17. The method of claim 14 wherein the step of spinning a second turbine comprises the steps of:

a) coupling a shaft [1205] to the first stage turbine [1130]; and b) attaching the shaft [1205] to the second stage turbine [1230] such that rotation of the first stage turbine [1130] causes the second stage turbine [1230] to rotate.

18. The method of claim 14 further comprising the step of:

providing a structure on at least one of the turbines [1130, 1230] which produces a sound as it rotates.

19. The method of claim 18 wherein the sound produced is one of the group consisting of:

a siren, whistle, buzzing, or whining sound.

* * * * *